US008334653B2

(12) United States Patent
Cha et al.

(10) Patent No.: US 8,334,653 B2
(45) Date of Patent: Dec. 18, 2012

(54) FILTER, PLASMA DISPLAY DEVICE THEREOF, AND RELATED TECHNOLOGIES

(75) Inventors: Hong Rae Cha, Seoul (KR); Ji Hoon Sohn, Seoul (KR); Sam Je Cho, Seoul (KR); Woo Sung Jang, Seoul (KR); Woon Seo Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 7 days.

(21) Appl. No.: 12/966,533

(22) Filed: Dec. 13, 2010

(65) Prior Publication Data

US 2011/0080084 A1 Apr. 7, 2011

Related U.S. Application Data

(63) Continuation of application No. 11/855,786, filed on Sep. 14, 2007, now abandoned.

(30) Foreign Application Priority Data

Sep. 14, 2006 (KR) ..... 10-2006-0089170

(51) Int. Cl.
*H01J 17/49* (2012.01)

(52) U.S. Cl. ..... 313/587; 313/582; 313/112

(58) Field of Classification Search ..... 313/112, 313/587, 582
See application file for complete search history.

(56) References Cited

U.S. PATENT DOCUMENTS

| | | | | |
|---|---|---|---|---|
| 6,657,387 | B1 * | 12/2003 | Yoo | 313/587 |
| 6,995,907 | B2 | 2/2006 | Osawa et al. | |
| 2006/0145578 | A1 | 7/2006 | Park et al. | |

FOREIGN PATENT DOCUMENTS

| | | | |
|---|---|---|---|
| KR | 10-20000067640 | A | 11/2000 |
| KR | 10-20040020094 | A | 3/2004 |
| KR | 10-20050091815 | A | 9/2005 |

OTHER PUBLICATIONS

Korean Intellectual Property Office (KIPO) Notice of Preliminary Rejection, Dec. 15, 2006, Application No. 10-2006-0089170, 8 pages total (including English translation).

KIPO Notice of Preliminary Rejection, Feb. 16, 2007, Application No. 10-2006-0089170, 6 pages total (including English translation).

KIPO Notice of Allowance, Jun. 7, 2007, Application No. 10-2006-0089170, 7 pages total (including English translation).

* cited by examiner

*Primary Examiner* — Nimeshkumar Patel
*Assistant Examiner* — Anthony Perry
(74) *Attorney, Agent, or Firm* — Fish & Richardson P.C.

(57) ABSTRACT

A display apparatus includes a plasma display panel (PDP) and a filter. The PDP has a display surface, and the filter has a panel side facing the display surface of the PDP and an opposing viewer side facing away from the display surface. The filter includes a base unit. The filter also includes pattern units that absorb external light from the viewer side. The pattern units have boundaries that define widths of pattern tops and widths of pattern bottoms. A distance between a pattern top and a pattern bottom defines a pattern height. A distance between adjacent boundaries, of a pair of adjacent pattern units, at adjacent pattern bottoms can be less than a distance between the adjacent boundaries at adjacent pattern tops, less than the pattern height, and greater than a width of at least one of the pattern bottoms.

13 Claims, 11 Drawing Sheets

Fig. 13
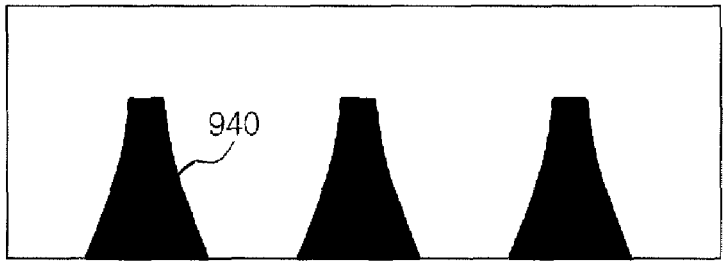
Fig. 14
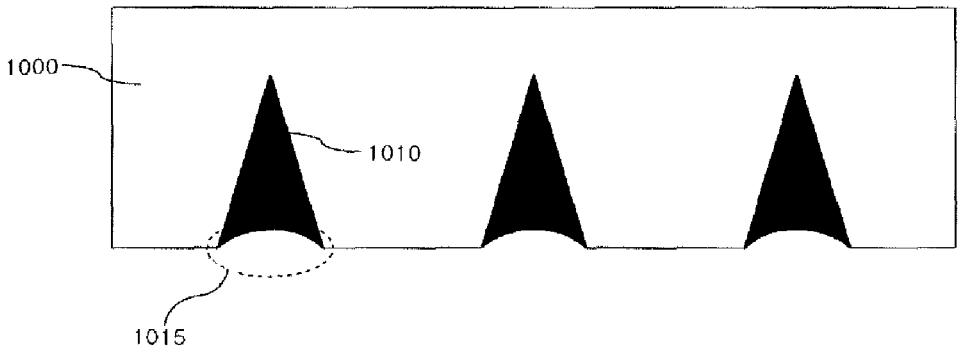
Fig. 15
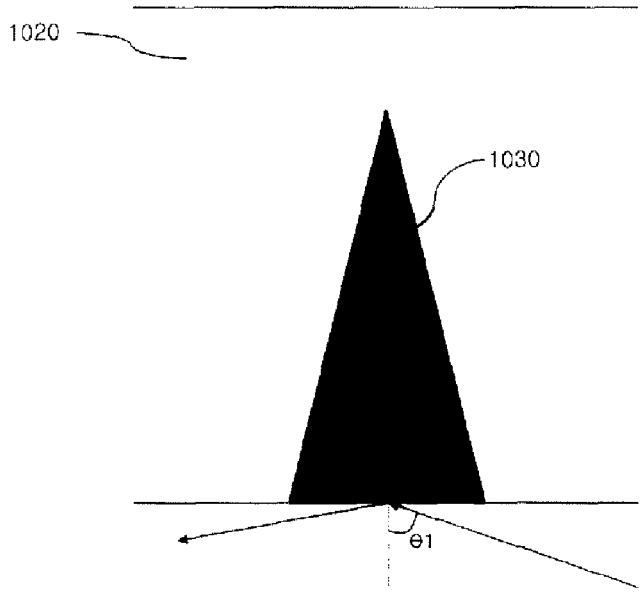
Fig. 16

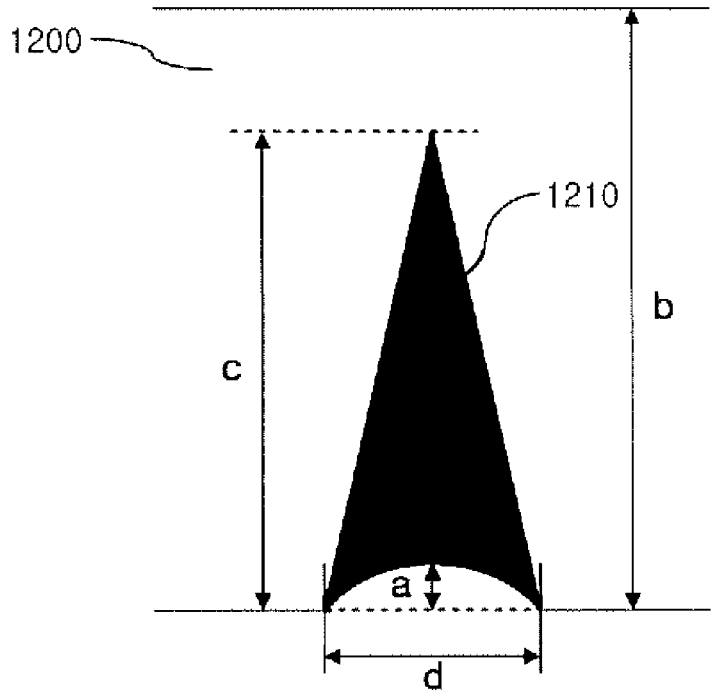
Fig. 19
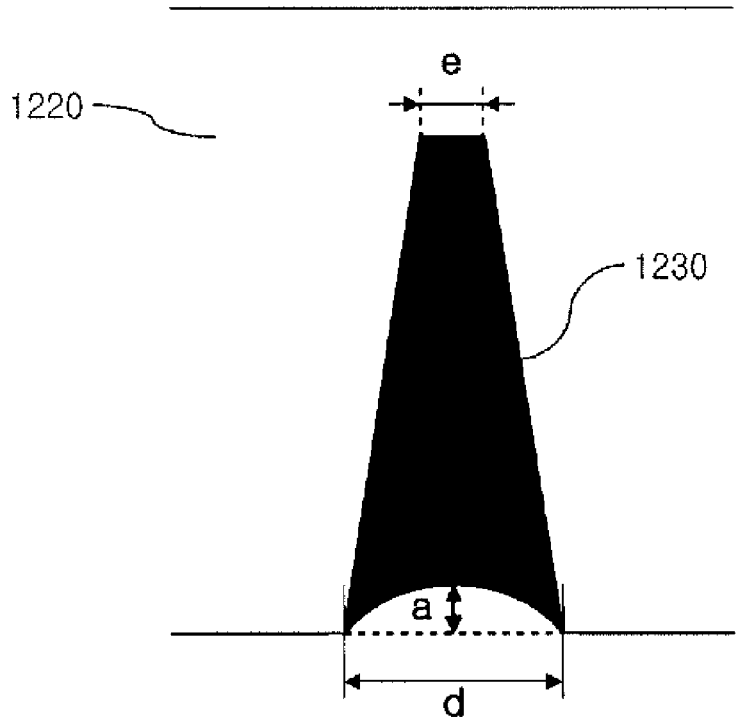

FILTER, PLASMA DISPLAY DEVICE THEREOF, AND RELATED TECHNOLOGIES

CROSS-REFERENCE TO RELATED APPLICATIONS

This application is a continuation of U.S. application Ser. No. 11/855,786, filed Sep. 14, 2007, now pending, and claims priority to Korean Patent Application No. 10-2006-0089170, filed Sep. 14, 2006, in the Korean Intellectual Property Office, both of which are incorporated by reference.

BACKGROUND

1. Field

This disclosure relates to a filter and a plasma display device in which an external light shielding sheet is manufactured and disposed at a front of a panel in order to shield external light incident upon the panel so that the bright room contrast of the panel is enhanced while maintaining the luminance of the panel.

2. Description of the Related Art

Generally, a plasma display panel (PDP) displays images including text and graphic images by applying a predetermined voltage to electrodes installed in a discharge space to cause a gas discharge and then exciting phosphors with the aid of plasma generated as a result of the gas discharge. The PDP can be manufactured as large-dimension, light and thin flat displays. In addition, the PDP can provide wide vertical and horizontal viewing angles, full colors and high luminance.

External light can be reflected by a front surface of the PDP due to white phosphors that are exposed on a lower substrate of the PDP when the PDP displays black images. For this reason, the PDP may mistakenly recognize the black images as being brighter than they actually are, thereby causing contrast degradation.

SUMMARY

In one general aspect, a display apparatus comprises a plasma display panel (PDP) having a display surface. The apparatus further comprises a filter having a panel side facing the display surface of the PDP and an opposing viewer side facing away from the display surface of the PDP. The filter includes a base unit, and the filter also includes pattern units that absorb external light from the viewer side. The pattern units have boundaries defined by intersections of the pattern units and the base unit. The boundaries of each pattern unit define a width of a pattern top disposed toward one of the panel side and the viewer side and define a width of a pattern bottom disposed toward the other of the panel side and the viewer side. A distance between the pattern top and the pattern bottom define a pattern height. A distance between adjacent boundaries, of a pair of adjacent pattern units, at adjacent pattern bottoms is: less than a distance between the adjacent boundaries at adjacent pattern tops, less than the pattern height, and greater than a width of at least one of the pattern bottoms.

Implementations can include one or more of the following features. For example, the distance between the adjacent boundaries, of the pair of adjacent pattern units, at the adjacent pattern tops can be 1.0 to 3.25 times the distance between the adjacent boundaries at the adjacent pattern bottoms. The pattern height can be 0.89 to 4.25 times the distance between the adjacent boundaries, of the pair of adjacent pattern units, at the adjacent pattern bottoms. The adjacent pattern bottoms can be disposed toward the panel side of the filter and the adjacent pattern tops can be disposed toward the viewer side of the filter. In some examples, at least one of the pattern units can be configured with a substantially triangular prism shape.

In another general aspect, a display apparatus comprises a plasma display panel (PDP) having a display surface. The apparatus further comprises a filter having a panel side facing the display surface of the PDP and an opposing viewer side facing away from the display surface of the PDP. The filter includes a base unit, and the filter also includes pattern units that absorb external light from the viewer side. The pattern units have boundaries defined by intersections of the pattern units and the base unit. The boundaries define widths of pattern tops disposed toward one of the panel side and the viewer side and define widths of pattern bottoms disposed toward the other of the panel side and the viewer side. The pattern bottoms are wider than the pattern tops. A distance between adjacent boundaries, of a pair of adjacent pattern units, at adjacent pattern tops is 1.0 to 3.25 times a distance between the adjacent boundaries at adjacent pattern bottoms.

Implementations can include one or more of the following features. For example, the distance between the adjacent boundaries at the adjacent pattern tops can be 1.25 to 2.5 times the distance between the adjacent boundaries at the adjacent pattern bottoms. The pattern bottoms cam be disposed toward the panel side of the filter and the pattern tops can be disposed toward the viewer side of the filter. The distance between the adjacent boundaries, of the pair of adjacent pattern units, at the adjacent pattern tops can be 90 μm to 130 μm, and the distance between the adjacent boundaries at the adjacent pattern bottoms can be 40 μm to 90 μm. In some examples, a refractive index of the pattern units is greater than a refractive index of the base unit.

In another general aspect, a display apparatus comprises a plasma display panel (PDP) having a display surface. The apparatus further comprises a filter having a panel side facing the display surface of the PDP and an opposing viewer side facing away from the display surface of the PDP. The filter includes a base unit, and the filter also includes pattern units that absorb external light from the viewer side. The pattern units have boundaries defined by intersections of the pattern units and the base unit. The boundaries define widths of pattern tops disposed toward one of the panel side and the viewer side and define widths of pattern bottoms disposed toward the other of the panel side and the viewer side. The pattern bottoms are wider than the pattern tops. A distance between adjacent boundaries, of a pair of adjacent pattern units, at adjacent pattern tops is 1.0 to 3.25 times a distance between the adjacent boundaries at adjacent pattern bottoms. A refractive index of the pattern units is higher than a refractive index of the base unit, a difference between the refractive index of the pattern units and the refractive index of the base unit being 0.05 to 0.3.

Implementations can include one or more of the following features. For example, the pattern bottoms can be disposed toward the panel side of the filter and the pattern tops can be disposed toward the viewer side of the filter. The distance between the adjacent boundaries at the adjacent pattern tops can be 1.25 to 2.5 times the distance between the adjacent boundaries at the adjacent pattern bottoms. The distance between the adjacent boundaries, of the pair of adjacent pattern units, at the adjacent pattern tops can be 90 μm to 130 μm, and the distance between the adjacent boundaries at the adjacent pattern bottoms can be 40 μm to 90 μm.

In another general aspect, a display apparatus comprises a plasma display panel (PDP) having a display surface. The apparatus further comprises a filter having a panel side facing the display surface of the PDP and an opposing viewer side facing away from the display surface of the PDP. The filter includes a base unit, and the filter also includes pattern units that absorb external light from the viewer side. The pattern units have boundaries defined by intersections of the pattern units and the base unit. The boundaries define widths of pattern tops disposed toward one of the panel side and the viewer side and define widths of pattern bottoms disposed toward the other of the panel side and the viewer side. A distance between a pattern top and a pattern bottom of a pattern unit defines a pattern height. The pattern height is 0.89 to 4.25 times a distance between adjacent boundaries, of a pair of adjacent pattern units, at adjacent pattern bottoms.

Implementations can include one or more of the following features. For example, the pattern height can be 1.5 to 3.0 times the distance between the adjacent boundaries, of the pair of adjacent pattern units, at the adjacent pattern bottoms.

A thickness of the base unit can be 1.01 to 2.25 times the pattern height. A thickness of the base unit can be 1.01 to 1.5 times the pattern height.

The pattern bottoms can be disposed toward the panel side of the filter and the pattern tops can be disposed toward the viewer side of the filter.

In another general aspect, a display apparatus comprises a plasma display panel (PDP) having a display surface. The apparatus further comprises a filter having a panel side facing the display surface of the PDP and an opposing viewer side facing away from the display surface of the PDP. The filter includes a base unit, and the filter also includes pattern units that absorb external light from the viewer side. The pattern units have boundaries defined by intersections of the pattern units and the base unit. The boundaries define widths of pattern tops disposed toward one of the panel side and the viewer side and define widths of pattern bottoms disposed toward the other of the panel side and the viewer side. A distance between adjacent boundaries, of a pair of adjacent pattern units, at adjacent pattern bottoms is greater than a width of at least one of the pattern bottoms.

Implementations can include one or more of the following features. For example, the distance between the adjacent boundaries, of the pair of adjacent pattern units, at the adjacent pattern bottoms can be 1.1 to 5 times the width of the at least one pattern bottom. The distance between the adjacent boundaries, of the pair of adjacent pattern units, at the adjacent pattern bottoms can be 1.5 to 3.5 times the width of the at least one pattern bottom.

The pattern bottoms can be disposed toward the panel side of the filter, and the pattern tops can be disposed toward the viewer side of the filter. In some examples, a refractive index of the pattern units is greater than a refractive index of the base unit.

Other features and advantages will be apparent from the following description and the claims.

BRIEF DESCRIPTION OF THE DRAWINGS

FIGS. 9 to 13 are cross-sectional views illustrating shapes of pattern units.

FIGS. 14 to 19 are cross-sectional views of pattern units with concave bottom profiles.

DETAILED DESCRIPTION

In some implementations, a plasma display device can shield external light incident upon the plasma display panel (PDP) and prevent light from being reflected. In at least one implementation, the bright room contrast of the plasma panel can be enhanced while maintaining the luminance of the PDP.

Figure 1:
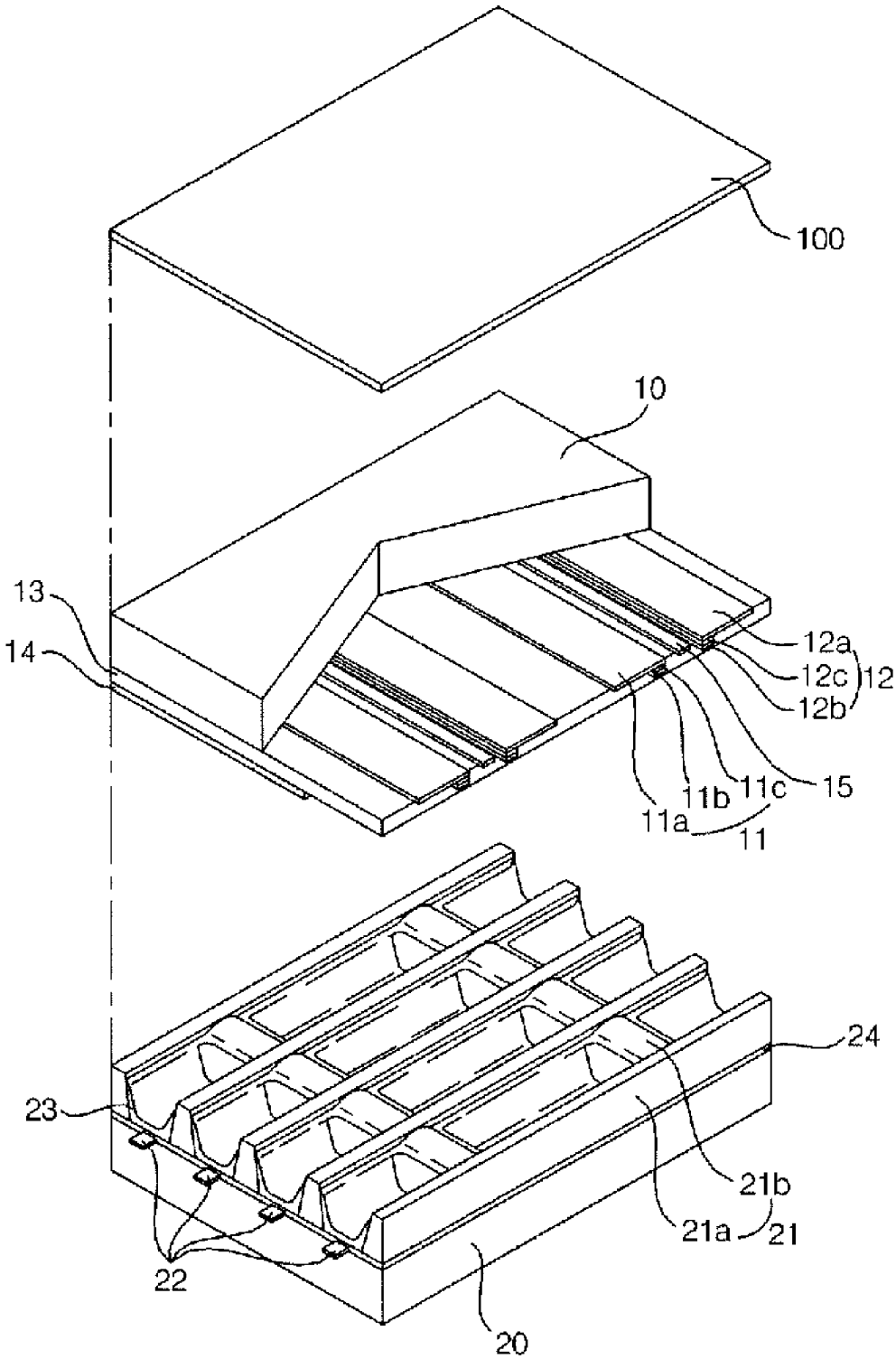
FIG. 1 is a perspective view of an example plasma display panel.

FIG. 1 is a perspective view illustrating an implementation of a PDP. As shown in FIG. 1, the PDP includes an upper substrate 10 and a plurality of electrode pairs formed on the upper substrate 10, each electrode pair including a scan electrode 11 and a sustain electrode 12. The PDP of FIG. 1 also includes a lower substrate 20 and a plurality of address electrodes 22 that are formed on the lower substrate 20.

Each electrode pair 11 and 12 includes transparent electrodes 11*a* and 12*a* and bus electrodes 11*b* and 12*b*. The transparent electrodes 11*a* and 12*a* may be made of indium-tin-oxide (ITO). The bus electrodes 11*b* and 12*b* may be made of a metal such as silver (Ag) or chromium (Cr) or may be made with a stack of chromium/copper/chromium (Cr/Cu/Cr) or a stack of chromium/aluminium/chromium (Cr/Al/Cr). The bus electrodes 11*b* and 12*b* are respectively formed on the transparent electrodes 11*a* and 12*a* and reduce a voltage drop caused by the transparent electrodes 11*a* and 12*a*, which have high resistance.

The sustain electrode pair 11 and 12 can be composed of a stacked structure of the transparent electrodes 11*a* and 12*a* and the bus electrodes 11*b* and 12*b* or only the bus electrodes 11*b* and 12*b* without the transparent electrodes 11*a* and 12*a*. Because the latter structure does not use the transparent electrodes 11*a* and 12*a*, a panel can be manufactured at a decreased cost. The bus electrodes 11*b* and 12*b* used in the structure can be made of various materials such as a photosensitive material in addition to the above-described materials.

Black matrices (BMs) can be formed on the upper substrate 10 and arranged between the transparent electrodes 11*a* and 12*a* and the bus electrodes 11*b* and 12*b* of the scan electrode 11 and the sustain electrode 12. The black matrices perform a light shielding function by absorbing external light incident upon the upper substrate 10 so that light reflection can be reduced. In addition, the black matrices can enhance the purity and contrast of the upper substrate 10.

The black matrices can include a first black matrix 15 formed in the upper substrate 10. The first black matrix 15 overlaps with a barrier rib 21 and second black matrices 11*c* and 12*c*, which are formed between the transparent electrodes 11*a* and 12*a* and the bus electrodes 11*b* and 12*b*. The first black matrix 15 and the second black matrices 11*c* and 12*c*, which are collectively referred to as a black layer or a black electrode layer, may be physically connected to each other and formed at the same time in a forming process or may be not physically connected to each other and not formed at the same time.

When they are physically connected to each other, the black matrix 15 and the black matrixes 11*c* and 12*c* are made of the same material. When they are physically separated from each other, the black matrix 15 and the black matrixes 11*c* and 12*c* may be made of different materials.

The bus electrodes 11*b* and 12*b* or the barrier ribs 21 may have a dark color and may thus serve the functions of the black matrices, e.g., a light shield function and a contrast enhancement function. Alternatively, it is possible for one or more components to operate as or to achieve results earlier attributed to the black matrices. For example, a first element (for example, the dielectric layer 13) on the upper substrate 10 and a second element (for example, the barrier ribs) on the lower substrate 20 may have complementary colors so that the overlapping area of the first and second elements can appear black as viewed from the front of the PDP. In this case, the overlapping area of the first and second elements may serve the functions of the black matrices.

An upper dielectric layer 13 and a passivation layer 14 (or a protective film) are deposited on the upper substrate 10 on which the scan electrodes 11 and the sustain electrodes 12 are formed in parallel with one another. Charged particles generated by a discharge accumulate in the upper dielectric layer 13. The upper dielectric layer 13 may protect the electrode pairs. The passivation layer 14 protects the upper dielectric layer 13 from sputtering of the charged particles and enhances emission efficiency of secondary electrons.

The address electrodes 22 intersect the scan electrodes 11 and the sustain electrodes 12. A lower dielectric layer 24 and the barrier ribs 21 are formed on the lower substrate 20 in which the address electrodes 22 are formed.

A phosphor layer 23 is formed on the surface of the lower dielectric layer 24 and the barrier ribs 21. The barrier ribs 21 include one or more vertical barrier ribs 21*a* and one or more horizontal barrier ribs 21*b* that form a closed-type barrier rib structure. The barrier ribs 21 physically divides a discharge cell and prevent ultraviolet (UV) rays and visible light generated by a discharge in one cell from leaking into adjacent discharge cells.

Referring to FIG. 1, a filter 100 may be disposed at the front of the PDP. The filter 100 may include an external light shielding sheet, an AR (anti-reflection) sheet, a NIR (near infrared) shielding sheet, an EMI (electromagnetic interference) shielding sheet, a diffusion sheet, and an optical sheet.

If the distance between the filter 100 and the PDP is 10 μm to 30 μm, the filter can effectively shield light incident upon the PDP and can emit light (hereinafter referred to as panel light) generated by the PDP. In order to protect the PDP against external impact such as pressure, the distance between the filter 100 and the PDP may be 30 μm to 120 μm. An adhesive layer, which can absorb impact, may be disposed between the filter 100 and the PDP in order to further protect the PDP against external impact.

Various shapes of barrier rib 21 structure can be used, such as the barrier rib 21 structure shown in FIG. 1. Example structures include a differential-type barrier rib structure in which the vertical barrier rib 21*a* and the horizontal barrier rib 21*b* have different heights, a channel-type barrier rib structure in which a channel that can be used as an exhaust passage is formed in at least one of the vertical barrier rib 21*a* and the horizontal barrier rib 21*b*, and a hollow-type barrier rib structure in which a hollow cavity is formed in at least one of the vertical barrier rib 21*a* and the horizontal barrier rib 21*b*.

In the differential-type barrier rib structure, the height of the horizontal barrier rib 21*b* may be higher than that of the vertical barrier rib 21*a*, and in the channel-type barrier rib structure or the hollow-type barrier rib structure, a channel or a hollow cavity may be formed in the horizontal barrier rib 21*b*.

In some implementations, red (R), green (G), and blue (B) discharge cells may be arranged in a straight line. This is an example only, and the discharge cells may be arranged in other ways. For example, R, G, and B discharge cells may be arranged as a triangle or a delta-type shape. In some examples, the discharge cells may have various polygonal shapes, such as a quadrilateral shape, a pentagonal shape and a hexagonal shape.

The phosphor layer 23 is excited by UV rays that are generated upon a gas discharge. As a result, the phosphor layer 23 generates, for example, one of R, G, and B visible light rays. A discharge space is provided between the upper and lower substrates 10 and 20 and the barrier ribs 21. A mixture of inert gases, e.g., a mixture of helium (He) and xenon (Xe), a mixture of neon (Ne) and Xe, or a mixture of He, Ne, and Xe is injected into the discharge space.

Figure 2:
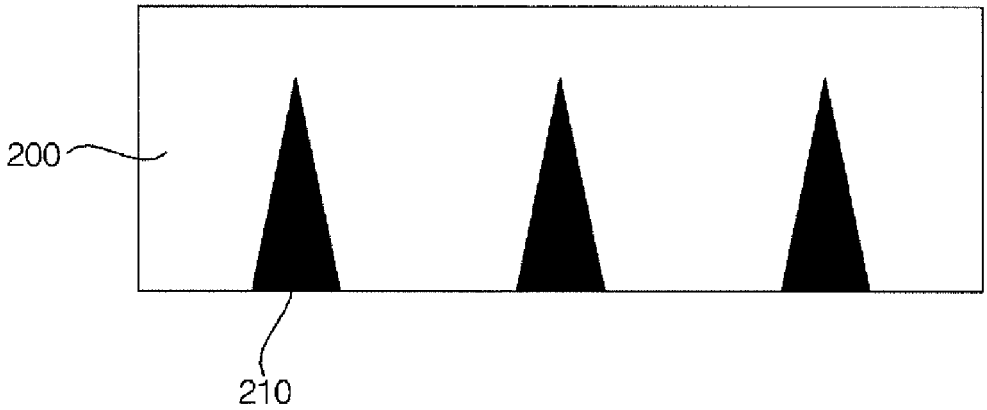
FIG. 2 is a cross-sectional view schematically illustrating an example structure of an external light shielding sheet.

FIG. 2 is a cross-sectional view of an external light shielding sheet that can be included in a filter. The external light shielding sheet includes a base unit 200 and one or more pattern units 210.

The base unit 200 may be formed of a transparent plastic material, for example a UV-hardened resin-based material, enabling light to smoothly transmit therethrough. Alternately, the base unit 200 may be formed of a rigid material such as hard glass to enhance the protection of the surface of the PDP.

Referring to FIG. 2, the pattern units 210 may be formed in triangular shapes (e.g., a triangular-prism-type shape) as well as various other suitable shapes. The pattern units 210 are formed of a darker material than the base unit 200. For example, the pattern units 210 are formed of a black carbon-based material or covered with a black dye in order to increase the absorption of external light.

The pattern units 210 can have boundaries (e.g., surfaces) defined by intersections (e.g., where the pattern units 210 interface the base unit 200) of the pattern units 210 and the base unit 200. The boundaries of the pattern units can define the widths of pattern tops and the widths of pattern bottoms. For example, two boundary surfaces of a pattern unit can define a pattern top and a pattern bottom. Each of the boundary surfaces of the pattern unit can define an edge of the pattern top and the pattern bottom defined between the two surfaces. The pattern tops can be disposed toward one of the panel side and the viewer side, the pattern bottoms can be disposed toward the other of the panel side and the viewer side.

The boundaries of the pattern units can be sloped, and the pattern bottoms can be wider than the pattern tops. Hereinafter, the wider of the top and bottom of the pattern units 210 is referred to as a bottom of the pattern units 210.

According to FIG. 2, the bottoms of the pattern units 210 may be arranged at (e.g., face) a PDP side (e.g., a side facing a display surface of the PDP), and the tops of the pattern units 210 may be arranged at a viewer side (e.g., a side facing away from the PDP display surface). In some implementations, the bottom of the pattern units 210 may be arranged at the viewer side, and the top of the pattern units 210 may be arranged at the PDP side, contrary to the above arrangement.

In general, an external light source is located above the PDP and thus external light is highly likely to be diagonally incident upon the PDP from above within a predetermined angle range. At least partially because the external light is diagonally incident, it can be absorbed in the pattern units 210.

The pattern units 210 may include light-absorbing particles, and the light-absorbing particles may be resin particles colored or stained by a specific color. In order to improve the light absorbing effect, the light-absorbing particles may be colored, for example, by a black color.

The light-absorbing particles may have a size of 1 μm or more. In this case, it is possible to facilitate the manufacture of the light-absorbing particles and the insertion of the light absorption particles into the pattern units 210 and to improve the absorption of external light. Also, if the size of the light-absorbing particle is 1 μm or more, each of the pattern units 210 may include 10% or more of the light-absorbing particles, by weight. In this fashion, it is possible to effectively absorb external light refracted into the pattern units 210.

FIGS. 3 to 6 are cross-sectional views illustrating a structure of an external light shielding sheet and illustrate optical characteristics of the external light shielding sheets.

Figure 3:
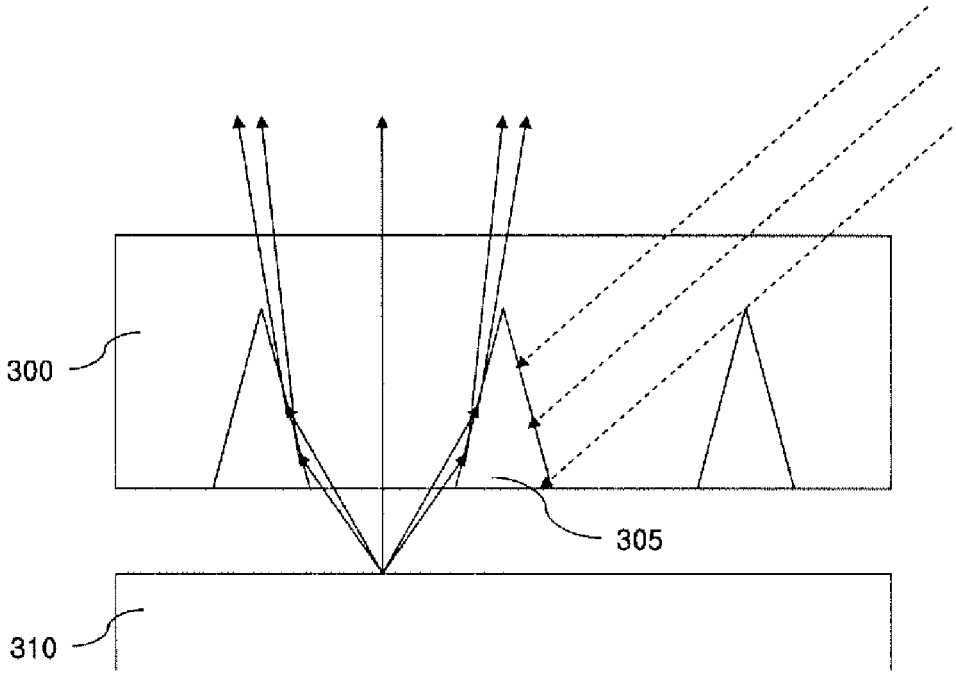
FIGS. 3 to 6 are cross-sectional views illustrating optical characteristics of an external light shielding sheet.

FIG. 3 illustrates the situation in which the tops of a plurality of pattern units 305 face toward a user. Referring to FIG. 3, the refractive index of the pattern units 305, particularly, the refractive index of at least the slanted surface of the pattern units 305, is lower than the refractive index of the base unit 300 in order to enhance the reflectivity of light emitted from the PDP by enabling reflection of visible light emitted from the PDP.

As described above, external light which reduces the bright room contrast of the PDP is highly likely to be above the PDP. Referring to FIG. 3, according to Snell's law, external light (illustrated as a dotted line) that is diagonally incident upon the external light shielding sheet is refracted into and absorbed by the pattern units 310 which have a lower refractive index than the base unit 300. External light refracted into the pattern units 305 may be absorbed by the light absorption particles therein.

Also, panel light (illustrated as a solid line) that is emitted from the PDP 310 for displaying is reflected from the slanted surface of the pattern units 305 to the outside, i.e., toward the viewer. Since the angle between panel light and the slanted surfaces of the pattern units 305 is greater than the angle between external light and the slanted surfaces of the pattern units 305, external light is refracted into and absorbed by the pattern units 305, whereas panel light is reflected by the pattern units 305.

As described above, external light (illustrated as a dotted line) is refracted into and absorbed by the pattern units 305 and light (illustrated as a solid line) emitted from the PDP 310 is reflected toward the viewer by the pattern units 305 because the angle between the external light and the slanted surface of the pattern units 305 is greater than the angle between the light emitted from the PDP 310 and the slanted surface of the pattern units 305, as illustrated in FIG. 3.

The external light shield sheet of FIG. 3 can absorb external light so that external light can be prevented from being reflected toward a user. Also, the external light shield sheet of FIG. 3 can enhance the reflection of light emitted from a PDP 310, increasing the bright room contrast of images displayed by the PDP 310.

In order to increase the absorption of external light and the reflection of light emitted from the PDP 310 in consideration of the angle of external light incident upon the PDP 310, the refractive index of the pattern units 305 can be configured 0.3-1.0 times higher than the refractive index of the base unit 300. In order to increase the total reflection of light emitted from the PDP 310 in consideration of the vertical viewing angle of the PDP, the refractive index of the pattern units 305 can be configured 0.3-0.8 times higher than the refractive index of the base unit 300.

As shown in FIG. 3, when a top of the pattern units 305 is arranged at the viewer side and the refractive index of the pattern units 305 is lower than the refractive index of the base unit 300, light emitted from the PDP 310 is reflected by the slanted surfaces of the pattern units 305 and thus spreads out toward the user, thereby resulting in unclear, blurry images, i.e., a ghost phenomenon.

Figure 4:
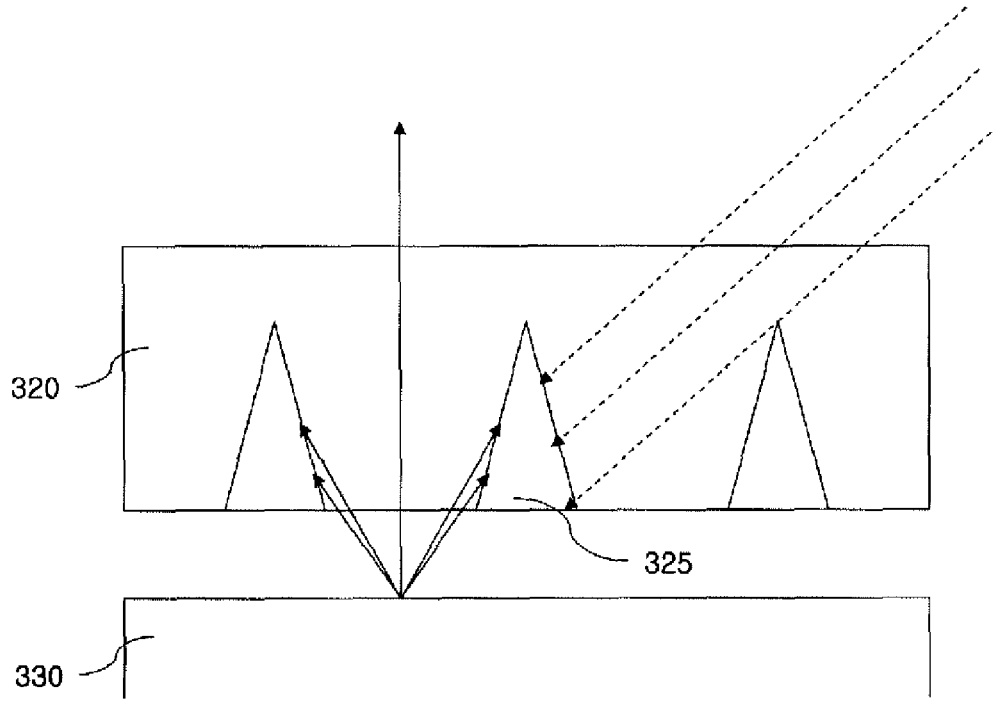

FIG. 4 illustrates the situation in which the tops of the pattern units 325 are arranged at the viewer side and the refractive index of the pattern units 325 is higher than the refractive index of the base unit 320. Referring to FIG. 4, when the refractive index of the pattern units 325 is higher than the refractive index of the base unit 320, according to Snell's law, external light incident upon the pattern units 325 and light emitted from a PDP 330 are absorbed by the pattern units 325.

Therefore, the ghost phenomenon may be reduced when the top of the pattern units 325 is arranged at the viewer side and the refractive index of the pattern units 325 is higher than the refractive index of the base unit 320.

In order to absorb as much panel light as possible and thus to prevent the ghost phenomenon, the difference between the refractive index of the pattern units 325 and the refractive index of the base unit 320 can be 0.05, with the refractive index of the pattern units being higher than that of the base unit.

When the refractive index of the pattern units 325 is higher than the refractive index of the base unit 320, a light transmittance ratio of the external light shielding sheet and bright room contrast may be reduced. Therefore, the difference between the refractive index of the pattern units 325 and the refractive index of the base unit 320 can be 0.05 in order to prevent the ghost phenomenon and in order not to considerably reduce a light transmittance ratio of the external light shielding sheet. Also, the refractive index of the pattern units 325 can be 1.0-1.3 times the refractive index of the base unit 320 to prevent the ghost phenomenon while maintaining the bright room contrast.

Figure 5:
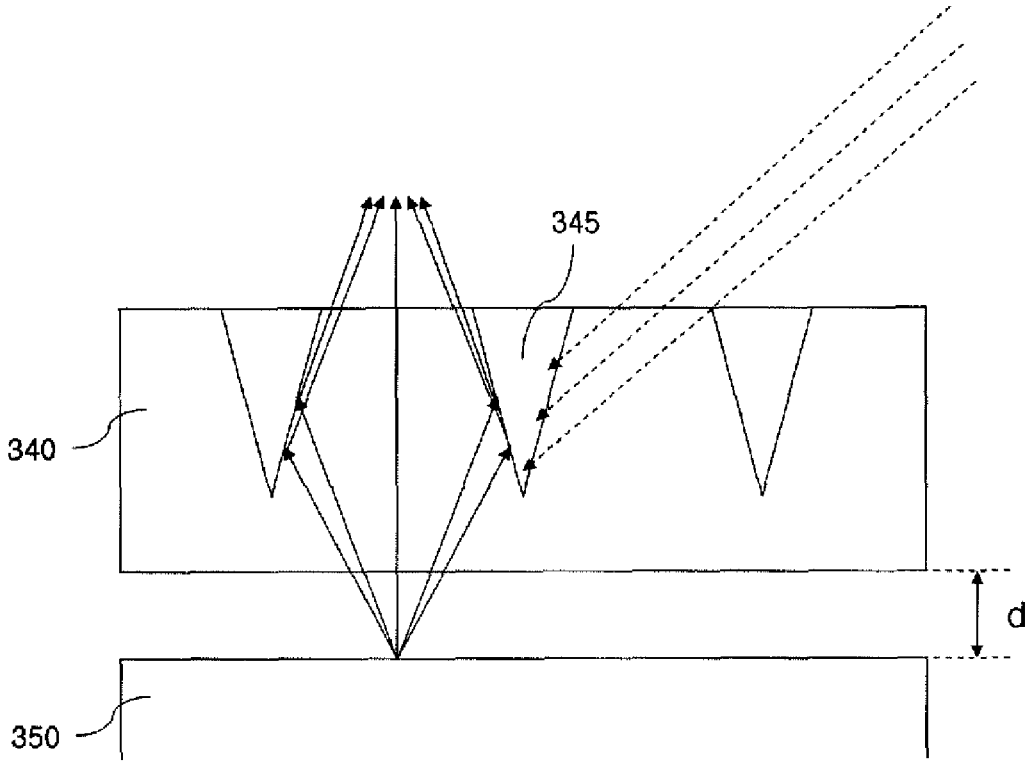

FIG. 5 illustrates the situation in which the bottoms of the pattern units 345 are arranged at the viewer side and the refractive index of the pattern units 345 is lower than the refractive index of the base unit 340. As illustrated in FIG. 5, external light is allowed to be absorbed in the bottom of the pattern units 345 by arranging the bottom of the pattern units 345 at the viewer side on which external light is incident, thereby enhancing the shielding of external light. Also, the distance between a pair of adjacent bottoms of adjacent pattern units 345 may be increased compared to the distance illustrated in the FIG. 4. Therefore, an aperture or opening ratio of the external light shielding sheet can be enhanced.

According to the implementation shown in FIG. 5, panel light emitted from a PDP 350 is reflected by the slanted surfaces of the pattern units 345 and is thus concentrated together with panel light that directly transmits through the base unit 340 without being reflected by the slanted surfaces of the pattern units 345. Therefore, it is possible to reduce the probability of occurrence or perception of the ghost phenomenon without considerably lowering the light transmittance ratio of the external light shielding sheet.

The distance d between the PDP 350 and the external light shielding sheet can be set to 1.5 to 3.5 mm, in order to prevent the ghost phenomenon as light from the PDP is reflected from the slanted surface of the pattern units 345 and is collected around light from the PDP which passes through the base unit 340.

Figure 6:
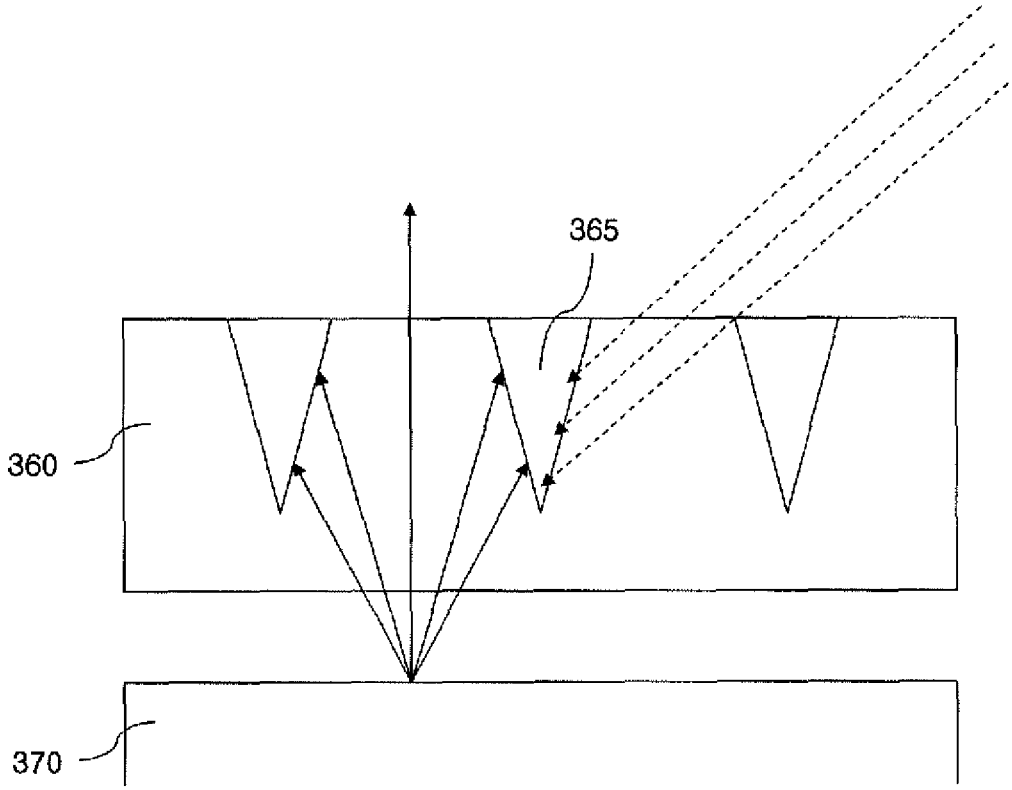

FIG. 6 illustrates the situation in which the bottoms of the pattern units 365 face toward a user and the refractive index of the pattern units 365 is higher than the refractive index of a base unit 360. Referring to FIG. 6, when the refractive index of the pattern units 365 is higher than the refractive index of the base unit 360, panel light incident upon the slanted surfaces of the pattern units 365 is likely to be absorbed by the pattern units 365. Accordingly, images are displayed by panel light that transmits through the base unit 360. Thus, it is possible to reduce the probability of occurrence or perception of the ghost phenomenon.

Also, since the refractive index of the pattern units 365 is higher than the refractive index of the base unit 360, it is possible to enhance the absorption of external light.

Figure 7:
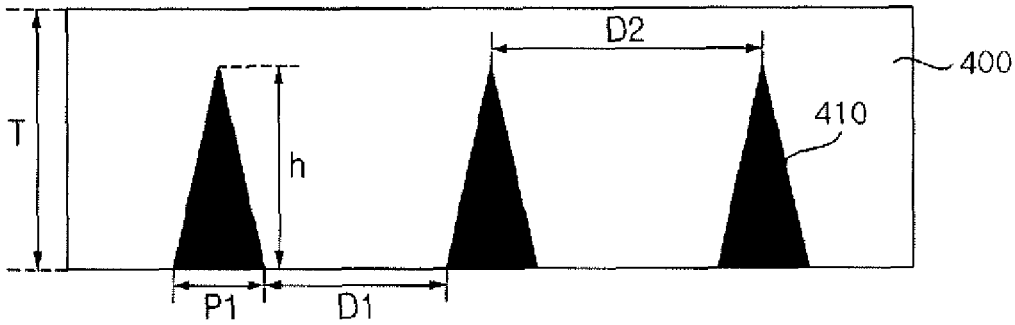
FIG. 7 is a cross-sectional view illustrating pattern units of an external light shielding sheet.

FIG. 7 is a cross-sectional view of an external light shield sheet. Referring to FIG. 7, when a thickness T of an external light shield sheet is 20-250 μm, it is possible to facilitate the manufacture of an external light shield sheet and obtain the appropriate light transmittance ratio and provide an external light shield sheet with an increased transmissivity. More specifically, the thickness T may be set to be 100-180 μm. In this case, it is possible to effectively absorb and shield external light using a plurality of pattern units 410 and to ensure the durability of an external light shield sheet.

Referring to FIG. 7, the pattern units 410 formed on the base unit 400 may be formed as triangles, and potentially, as equilateral triangles. Also, a bottom width P1 of the pattern units 410 may be 18 μm to 36 μm, and in this case, it is possible to ensure an optimum opening ratio and increase external light shielding efficiency so that light emitted from the PDP can be smoothly discharged toward a user side.

A height h of the pattern units 410 may be 80-170 μm. The slopes or gradient of the slanted surfaces of the pattern units 410 may be determined in consideration of the bottom width P1 and the height h so that the absorption of external light and the reflection of panel light can be increased, and that the pattern units 410 can be prevented from being short-circuited.

A distance D1 between adjacent boundaries of a pair of adjacent pattern units 410 at adjacent pattern bottoms may be 40-90 μm, and a distance D2 between the adjacent boundaries of the pair of adjacent pattern units 410 at adjacent pattern bottoms may be 90-130 μm. In this case, it is possible to achieve a sufficient aperture ratio to display images with increased luminance through the emission of panel light toward a user and provide a number of pattern units having slanted surfaces with an optimum slope for enhancing the absorption of external light and the emission of panel light.

The distance D1 may be 1.1-5 times the bottom width P1. In this case, it is possible to secure an optimum aperture ratio for displaying images. In particular, the distance D1 may be 1.5-3.5 times the bottom width P1. In this case, it is possible to optimize the absorption of external light and the emission of panel light.

The height h may be 0.89-4.25 times the distance D1 between adjacent pattern units. In this case, it is possible to prevent external light from being incident upon a PDP. In particular, the height h may be 1.5-3 times the distance D1. In this case, it is possible to prevent the pattern units 410 from being short-circuited and to optimize the reflection of panel light.

The distance D2 between adjacent boundaries of a pair of adjacent pattern units 410 at adjacent tops may be 1.0 to 3.25 times the distance D1 between the adjacent boundaries of a pair of adjacent pattern units 410 at adjacent bottoms. In this case, it is possible to achieve a sufficient opening ratio for displaying images with optimum luminance. The distance D2 between tops of the pair of adjacent pattern units may be set to be 1.2 to 2.5 times the distance D1 between bottoms of the pair of adjacent pattern units. In this case, it is possible to increase the reflection of light emitted from the PDP by the slanted surface of the pattern units 410.

Although a structure of the external light shielding sheet has been explained with the case where the top of the pattern units 410 is arranged at a viewer side, it is also applicable to the case where the bottom of the pattern units 410 is arranged at a viewer side.

Figure 8:
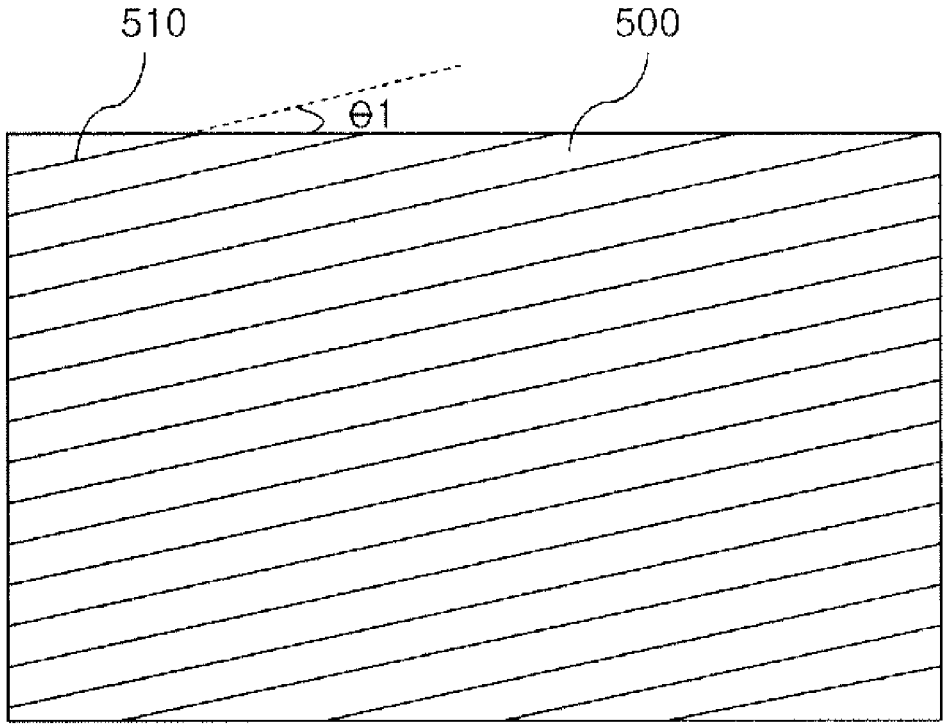
FIG. 8 is a view illustrating pattern units formed on an external light shielding sheet in a row.

FIG. 8 is a view illustrating the front shape of the pattern units formed on the external light shielding sheet in a row. As illustrated in the drawing, the pattern units 510 are formed on the base unit 500 at a predetermined interval apart from each other in a row or as stripes.

The moire phenomenon may occur when a plurality of pattern units of an external light shield sheet that are a predetermined distance apart from each other overlap black matrices, a black layer, bus electrodes, and barrier ribs that are formed on a PDP. The moire phenomenon refers to low-frequency patterns that are generated by overlapping similar types of grating patterns or interference between periodic images. For example, when mosquito nets are overlaid on each other, ripple or wave patterns appear.

Referring to FIG. 8, the moire phenomenon, which is generated when a black matrix, a black layer, a bus electrode and a barrier rib formed in the PDP overlap with a plurality of pattern units 510, can be reduced (e.g., the probability of occurrence or user perception can be reduced) by arranging the pattern units 510 diagonally with respect to the lengthwise (longitudinal) direction of the external light shield. The pattern units can be substantially parallel to one or more axes that are diagonal with respect to the longitudinal axis of the external light shield and that form one or more angles (e.g., θ1) with the longitudinal axis of the external light shield.

To reduce the moire phenomenon, the slanted angle θ1 of the plurality of pattern units 510 can be 0.5 to 20 degrees. That is, the moire phenomenon may be reduced when the pattern units 510 of the external light shielding sheet are diagonally formed with a black matrix, a black layer, a bus electrode and a barrier rib formed in the PDP at an angle of 0.5 to 20 degrees. Also, in consideration that an external light source is mostly located over the head of a viewer, an appropriate opening ratio is obtained while reducing the moire phenomenon when the slanted angle θ1 is 0.5 to 5 degrees, and thus, it is possible to enhance the reflection efficiency of light emitted from the PDP and to effectively shield external light.

In addition, due to the above-described reasons, the moire phenomenon may be reduced when the pattern units 510 of the external light shielding sheet are diagonally formed with a bus electrode which is formed on the upper substrate and a barrier rib which is formed on the lower substrate of the PDP at an angle of 0.5 to 20 degrees. Also, in consideration that an external light source is mostly located over the head of a viewer, an appropriate opening ratio is obtained while preventing the moire phenomenon when the angle between the pattern units and the bus electrode or the horizontal barrier rib is 0.5 to 5 degrees, and thus, it is possible to enhance the reflection efficiency of light emitted from the PDP and to effectively shield external light.

Referring to FIG. 8, the pattern units 510 are diagonally formed from the right-bottom to the left-top of the external light shielding sheet. In some implementations, however, the pattern units 510 may be diagonally formed from the left-top to the right-bottom of the external light shielding sheet at the same angle.

FIGS. 9 to 13 are cross-sectional views illustrating the shape of the pattern units of the external light shielding sheet in various implementations.

Figure 9:
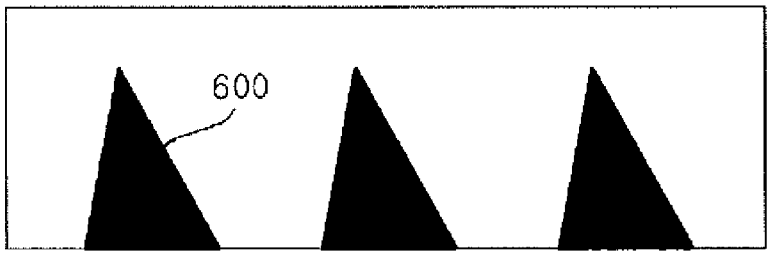

Referring to FIG. 9, the pattern units 600 may be may be asymmetrical with respect to their respective horizontal axes. That is, left and right slanted surfaces or boundaries of the pattern units 600 may have different areas or may form different angles with the bottom. In general, an external light source is located above the PDP, and thus, external light is highly likely to be incident upon the PDP from above within a predetermined angle range. One of a pair of slanted surfaces of each of the pattern units 900 upon which external light is directly incident refers to an upper slanted surface, and the other slanted surface refers to a lower slanted surface. In order to enhance the absorption of external light and the reflection of light emitted from the PDP, an upper slanted surface of two slanted surfaces of the pattern units 600 may be less steep than a lower slanted surfaces of the pattern units.

Figure 10:
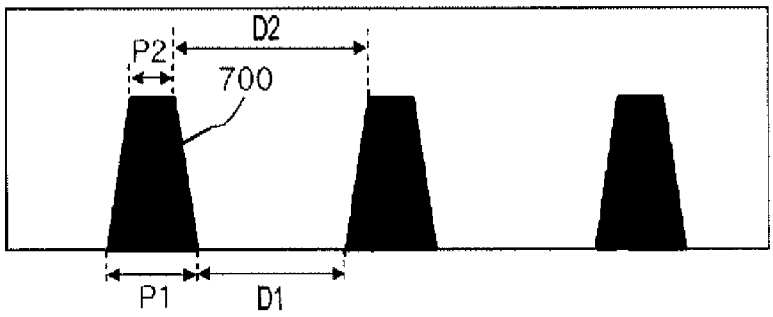

Referring to FIG. 10, the pattern units 710 may be trapezoidal. As illustrated in FIG. 10, a distance D1 between a pair of adjacent boundaries of the pattern units 700 at adjacent pattern bottoms can be less than a distance D2 between the adjacent boundaries at adjacent pattern tops. In FIG. 10, a top width P2 of the pattern units is less than a bottom width P1 of the pattern units. Also, the top width P2 of the pattern units 710 may be 10 μm or less. The slope of the slanted surfaces of the pattern units can be appropriately determined according to the relationship between the bottom width P1 and the top width P2 so that the absorption of external light and the reflection of light emitted from the PDP can be increased.

Figure 11:
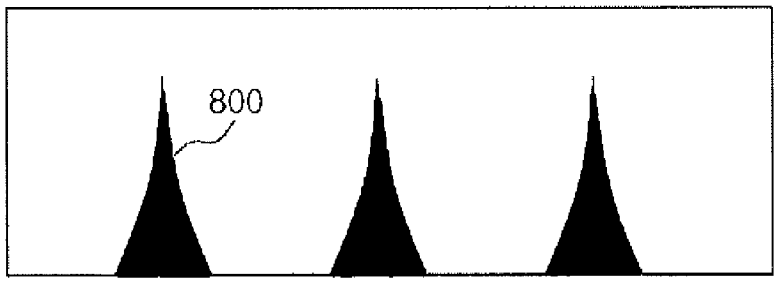
Figure 12:
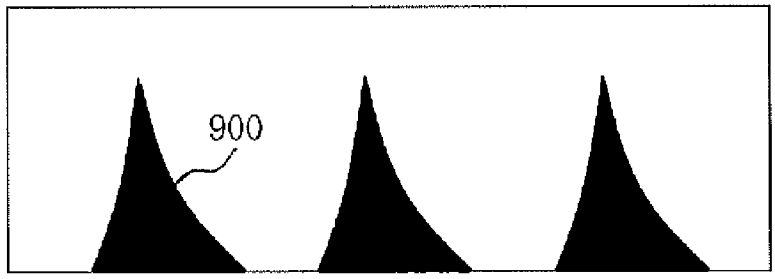

As illustrated in FIGS. 11 and 12, the pattern units 800, 900 of the external light shielding sheet may have a curved profile having a predetermined curvature at the left and right slanted surfaces. In this case, the slope angle of the slanted surface of the pattern units 800, 900 can lessen (become more gentle) in a direction to the top from the bottom.

Also, according to the embodiments in respect to the shape of the pattern units illustrated in FIGS. 9 to 12, edge portions of the pattern units may have a curved profile having a predetermined curvature.

Referring to FIG. 13, a pair of slanted surfaces of each of pattern units 940 may have curved lateral surfaces with a predetermined curvature. In order to further shield external light diagonally incident upon a PDP, the slope of the slanted surfaces of the pattern units 940 (or pattern units 800, 900) may lessen from the bottoms to the tops of the pattern units.

FIG. 14 is a cross-sectional view illustrating the shape of the pattern units with a concave bottom profile.

As shown in FIG. 14, bleeding phenomenon of the image (or image smear), which is generated as light emitted from the PDP is reflected on the bottom 1015 of the pattern units, can be reduced by forming a center of the bottom 1015 of the pattern units as a round hole or a concave (e.g., recessed) surface. Also, when the external light shielding sheet is attached to another functional sheet or the PDP, adhesive force can be enhanced as the area of the contact portion is increased. That is, since the external light shield sheet illustrated in FIG. 14 has a relatively large surface area, the external light shield sheet can be firmly attached onto another function sheet or a PDP.

The bottoms 1015 of the pattern units 1010 may be recessed so that the height of the pattern units 1010 becomes less at the center of each of the pattern units 1010 than on either side of the bottom 1015 of each of the pattern units 1010 (e.g., the outer most contour).

The pattern units 1010 may be formed by forming a plurality of grooves in a base unit 1000 and filling the grooves—at least partially and, in some implementations, not completely—with a light absorption material so that the bottoms 1015 of the pattern units 1010 can be slightly recessed. The bottom 1015 of the pattern units 1010 may be a concave shape in which the center area is depressed into the inside. Some of the grooves formed in the base unit 1000 may be filled by the light-absorbing materials and some of the grooves may be left as an occupied space.

FIG. 15 illustrates a pattern unit 1030 with a flat bottom. As shown in FIG. 15, light that is emitted from the PDP and diagonally incident upon the bottom of the pattern units 1030 may be reflected toward the PDP, when the bottom of the pattern units 1030 is flat. Images, to be displayed at a specific position by light reflected toward the PDP, are displayed around the specific position, and thus, the sharpness of the display images may be reduced because of the bleeding phenomenon.

Referring to FIG. 16, the incident angle θ2 of panel light that is diagonally incident upon the bottom of the pattern units 1010 having a depressed shape is smaller than the incident angle θ1 of panel light that is incident upon the bottom of the pattern units 1030 having a flat shape illustrated in FIG. 15. Therefore, the pattern unit 1010 can absorb panel light incident thereupon due to its recessed bottom, whereas the pattern unit 1030 reflects panel light incident thereupon. By using the pattern unit 1010 with a recessed bottom, it is possible to reduce image smear and thus to improve the sharpness of an image.

Figure 17:
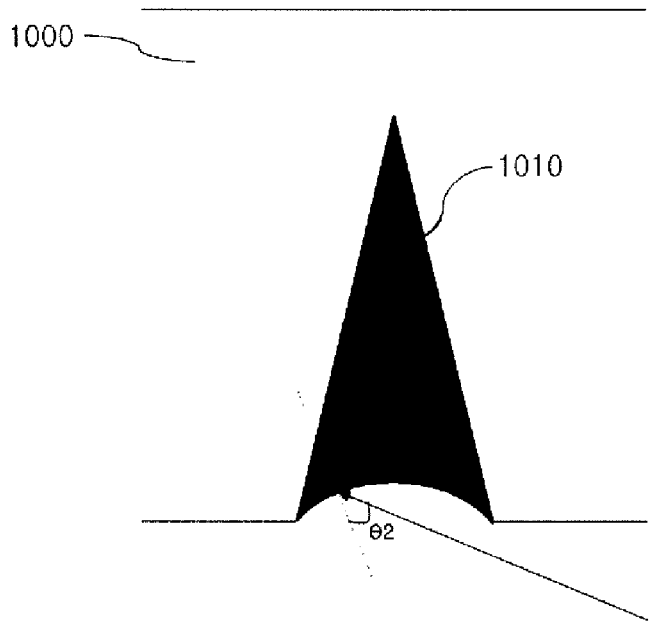

FIG. 17 is a cross sectional view illustrating a structure of the external light shielding sheet with the pattern units 1110 having a concave shape at the bottom. The external light shield sheet may be disposed so that the bottom of the pattern unit 1110 can face a viewer.

Referring to FIG. 17, the range of incidence angles of external light that is absorbed in the bottom of the pattern units 1110 can be increased by forming the bottom of the pattern units 1110 as a concave surface. That is, when the bottom of the pattern units 1110 is concave, the incident angle of external light that is incident upon the bottom of the pattern units 1110 may be increased, and thus, the absorption of external light can be increased.

Figure 18:
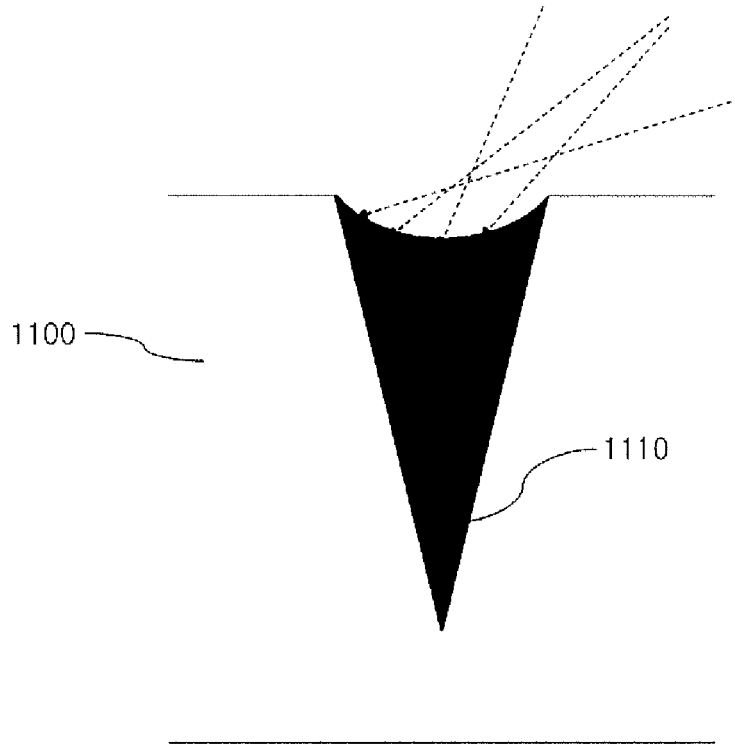

FIG. 18 is a cross-sectional view of a pattern unit 1210 with a recessed bottom. Table 1 presents experimental results indicating the relationships between a depth a of grooves, a bottom width d of pattern units with recessed bottoms, and the ability of the pattern units to reduce image smear.

TABLE 1

| Depth of Grooves (a) | Bottom Width of Pattern Units (d) | Smear Reduction |
|---|---|---|
| 0.5 μm | 27 μm | X |
| 1.0 μm | 27 μm | X |
| 1.5 μm | 27 μm | ○ |
| 2.0 μm | 27 μm | ○ |
| 2.5 μm | 27 μm | ○ |
| 3.0 μm | 27 μm | ○ |
| 3.5 μm | 27 μm | ○ |
| 4.0 μm | 27 μm | ○ |
| 4.5 μm | 27 μm | ○ |
| 5.0 μm | 27 μm | ○ |
| 5.5 μm | 27 μm | ○ |
| 6.0 μm | 27 μm | ○ |
| 6.5 μm | 27 μm | ○ |
| 7.0 μm | 27 μm | ○ |
| 7.5 μm | 27 μm | X |
| 8.0 μm | 27 μm | X |
| 9.0 μm | 27 μm | X |
| 9.5 μm | 27 μm | X |

Referring to Table 1, when the depth a is within the range of 1.5-7.0 μm, it is possible to reduce image smear and thus to increase the sharpness of an image.

In order to prevent the pattern unit 1210 from being damaged by an external shock and to facilitate the manufacture of the pattern unit 1210, the depth a may be within the range of 2-5 μm.

When a width d of the pattern unit 1210 is within the range of 18-35 μm, it is possible to secure an optimum aperture ratio for an effective emission of panel light and to increase the efficiency of shielding external light. Thus, the width d may be 3.6-17.5 times the depth a.

When a height of the pattern unit 1210 is 80-170 μm, the slopes of a pair of slanted surfaces of the pattern unit 1210 can become suitable enough to effectively absorb external light and to effectively reflect panel light. Thus, the height c may be 16-85 times the depth a.

When a thickness b of an external light shield sheet 1200 is 100-180 μm, it is possible to facilitate the transmission of panel light, to effectively absorb and shield external light and to enhance the durability of an external light shield sheet. Thus, the thickness b of the external light shield 1200 may be 20-90 times greater than the depth a.

FIG. 19 is a cross-sectional view of a pattern unit 1230 of an external light shield sheet 1220. The pattern unit 1230 may be trapezoidal. In this case, a top width e of the pattern unit 1230 may be less than a bottom width d of the pattern unit 1230. When the top width e is less than 10 μm, the slopes of a pair of slanted surfaces of the pattern unit 1230 can become suitable enough to effectively absorb external light and to effectively reflect panel light. Thus, the relationship between the depth a and the bottom width d may be the same as the relationship between the depth a and the width d of FIG. 18.

Figure 20:
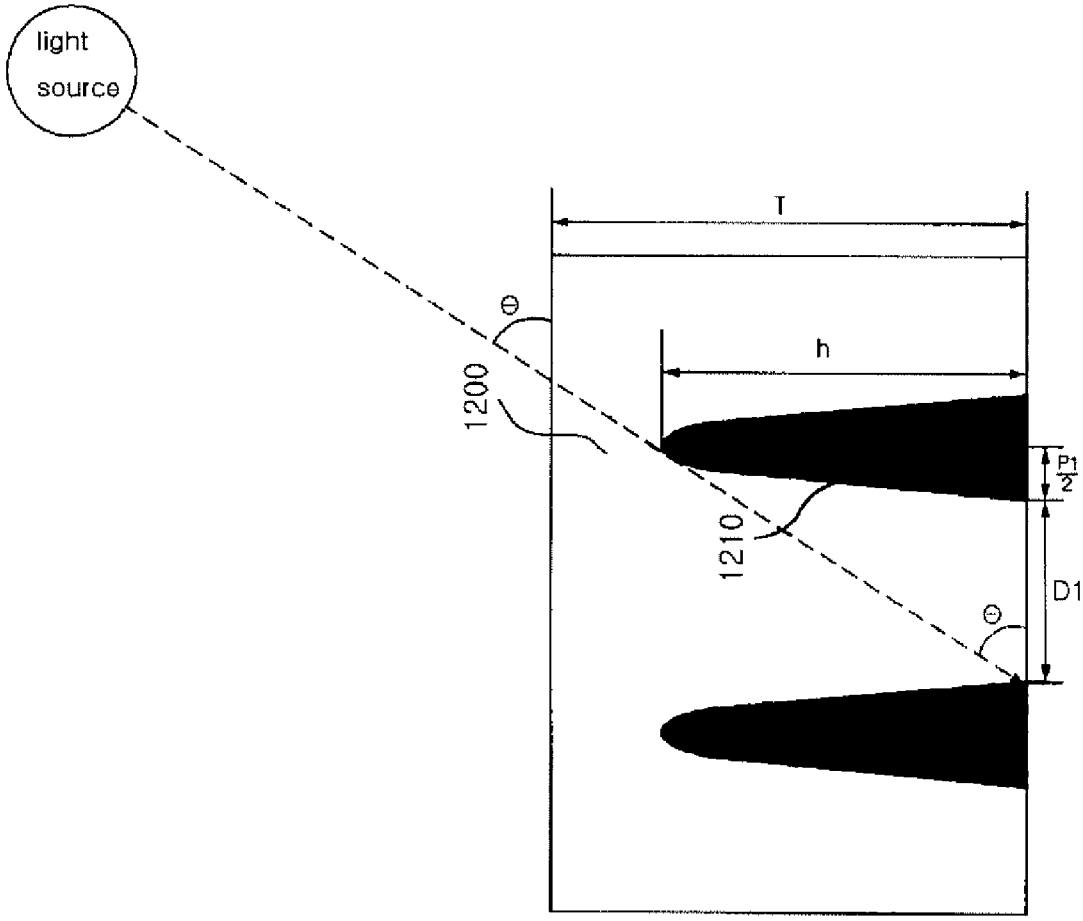
FIG. 20 is a cross sectional view for explaining the relation between a distance of adjacent pattern units formed on an external light shielding sheet and a height of the pattern units.

FIG. 20 is a cross sectional view illustrating a structure of the external light shielding sheet to explain the relation between the thickness of the external light shielding sheet 1200 and the height of the pattern units 1210.

Referring to FIG. 20, the thickness T of the external light shielding sheet is set to 100 μm to 180 μm in order to obtain an appropriate transmittance ratio of visible light emitted from the PDP for displaying images as well as to enhance the durability of the external light shielding sheet including the pattern units.

When the height h of the pattern units 1210 provided in the external light shielding sheet 1200 is 80 μm to 170 μm, the manufacture of the pattern units 1210 can be facilitated, the appropriate opening ratio of the external light shielding sheet 1200 can be obtained, and the function of shielding external light and the function of reflecting light emitted from the PDP can be increased.

The height h of the pattern units 1210 can be varied according to the thickness T of the external light shielding sheet 1200. In general, external light that considerably affects the bright room contrast of the PDP is highly likely to be incident upon the PDP from the above. Therefore, in order to effectively shield external light incident upon the PDP at an angle θ within a predetermined range, the height h of the pattern units 1210 can be within a predetermined percentage of the thickness T of the external light shielding sheet 1200.

As the height h of the pattern units 1210 increases, the thickness of the base unit, at a top region of the pattern units, decreases, and thus, dielectric breakdown may occur. On the other hand, as the height h of the pattern units 1210 decreases, more external light is likely to be incident upon the PDP at various angles within a predetermined range, and thus the external light shielding sheet may not properly shield the external light.

Table 2 presents experimental results about the dielectric breakdown and the external light shielding effect of the external light shielding sheet 1200 according to the thickness T of the external light shielding sheet 1200 and the height h of the pattern units 1210. Table 2 presents experimental results obtained by testing a plurality of external light shield sheets having the same thickness T and different pattern unit heights (h) for whether they cause dielectric breakdown and whether they can shield external light.

TABLE 2

| Thickness (T) of external light shielding sheet | Height (h) of pattern units | Dielectric breakdown | External light shielding |
|---|---|---|---|
| 120 μm | 120 μm | ○ | ○ |
| 120 μm | 115 μm | Δ | ○ |
| 120 μm | 110 μm | X | ○ |
| 120 μm | 105 μm | X | ○ |
| 120 μm | 100 μm | X | ○ |
| 120 μm | 95 μm | X | ○ |
| 120 μm | 90 μm | X | ○ |
| 120 μm | 85 μm | X | Δ |
| 120 μm | 80 μm | X | Δ |
| 120 μm | 75 μm | X | Δ |
| 120 μm | 70 μm | X | Δ |
| 120 μm | 65 μm | X | Δ |
| 120 μm | 60 μm | X | Δ |
| 120 μm | 55 μm | X | Δ |
| 120 μm | 50 μm | X | X |

Referring to Table 2, when the thickness T of the external light shielding sheet 1200 is 120 μm or more, and the height h of the pattern units 1210 is 115 μm or more, the pattern units are highly susceptible to dielectric breakdown, thereby increasing defect rates of the product. When the height h of the pattern units 1210 is 115 μm or less, the pattern units are less susceptible to dielectric breakdown, thereby reducing defect rates of the external light shielding sheet. However, when the height h of the pattern units 1210 is 85 μm or less, the shielding efficiency of external light may be reduced, and when the height h of the pattern units 1210 is 60 μm or less, external light is likely to be directly incident upon the PDP. When the height h of the pattern units is 90 μm to 110 μm, the shielding efficiency of the external light shielding sheet 1200 may be increased and the defect rates of the external light shielding sheet may be decreased.

In addition, when the thickness T of the external light shielding sheet 1200 is 1.01 to 2.25 times the height h of the pattern units 1210, it is possible to prevent dielectric breakdown of the top portion of the pattern units 1210 and to prevent external light from being incident upon the PDP. Also, in order to prevent dielectric breakdown and infiltration of external light into the PDP, to increase the reflection of light emitted from the PDP, and to secure optimum viewing angles, the thickness T the external light shielding sheet 1200 may be 1.01 to 1.5 times the height h of the pattern units 1210.

Table 3 presents experimental results about the occurrence of the moire phenomenon and the external light shielding effect of the external light shielding sheet according to different pattern unit bottom width P1-to-bus electrode width ratios, when the width of the bus electrode is 70 μm.

TABLE 3

| Bottom width of pattern units/Width of bus electrodes | Moire | External light shielding |
|---|---|---|
| 0.10 | Δ | X |
| 0.15 | Δ | X |
| 0.20 | X | Δ |
| 0.25 | X | ○ |

TABLE 3-continued

| Bottom width of pattern units/Width of bus electrodes | Moire | External light shielding |
|---|---|---|
| 0.30 | X | ○ |
| 0.35 | X | ○ |
| 0.40 | X | ○ |
| 0.45 | Δ | ○ |
| 0.50 | Δ | ○ |
| 0.55 | ○ | ○ |
| 0.60 | ○ | ○ |

Referring to Table 3, when the bottom width of the pattern units is 0.2 to 0.5 times the bus electrode width, the moire phenomenon can be reduced and external light incident upon the PDP can be reduced. Also, in order to reduce the moire phenomenon, to effectively shield external light, and to secure a sufficient opening ratio for discharging light emitted from the PDP, the bottom width of the pattern units can be set 0.25 to 0.4 times the bus electrode width.

Table 4 presents experimental results about the occurrence of the moire phenomenon and the external light shielding effect according to different pattern unit bottom width of the external light shielding sheet-to-vertical barrier rib width ratios, when the width of the vertical barrier rib is 50 μm.

TABLE 4

| Bottom widths of pattern units/Top width of vertical barrier ribs | Moire | External light shielding |
|---|---|---|
| 0.10 | ○ | X |
| 0.15 | Δ | X |
| 0.20 | Δ | X |
| 0.25 | Δ | X |
| 0.30 | X | Δ |
| 0.35 | X | Δ |
| 0.40 | X | ○ |
| 0.45 | X | ○ |
| 0.50 | X | ○ |
| 0.55 | X | ○ |
| 0.60 | X | ○ |
| 0.65 | X | ○ |
| 0.70 | Δ | ○ |
| 0.75 | Δ | ○ |
| 0.80 | Δ | ○ |
| 0.85 | ○ | ○ |
| 0.90 | ○ | ○ |

Referring to Table 4, when the bottom width of the pattern units is 0.3 to 0.8 times the top width of the vertical barrier rib, the moire phenomenon can be reduced and external light incident upon the PDP can be reduced. Also, in order to reduce the moire phenomenon, to effectively shield external light, and to secure a sufficient opening ratio for discharging light emitted from the PDP, the bottom width of the pattern units can be set 0.4 to 0.65 times the top width of the vertical barrier rib.

FIGS. 21 to 24 are cross-sectional views illustrating a structure of a filter. A filter may be disposed at a front of the PDP and may include an anti-reflection (AR)/near infrared (NIR) sheet, art EMI sheet, an external light shielding sheet and an optical sheet.

Figure 21:
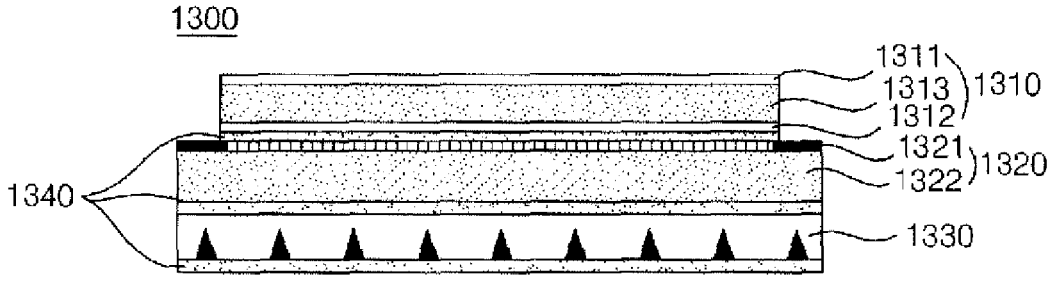
FIGS. 21 to 24 are cross sectional views illustrating a structure of a filter.
Figure 22:
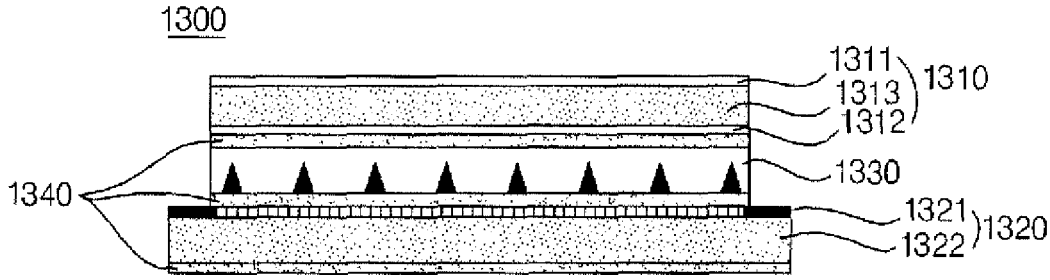

Referring to FIGS. 21 and 22, an anti-reflection (AR) layer 1311, which is attached onto a front surface of the base sheet 1313 and reduces glare by preventing the reflection of external light from the outside, is attached onto the AR/NIR sheet 1310. A near infrared (NIR) shielding layer 1312, which shields NIR rays emitted from the PDP so that signals provided by a device (such as a remote control that transmits signals using infrared rays) can be normally transmitted, is attached onto a rear surface of the AR/NIR sheet.

An EMI shield sheet 1320 includes an EMI layer 1321 that shields EMI emitted from the PDP so that the EMI can be prevented from being released to the outside. The EMI layer 1321 is attached onto a surface of a base sheet 1322, which is formed of a transparent plastic material. The EMI layer 1321 is generally formed of a conductive material in a mesh form. An invalid display area of the EMI sheet 1320 where no image is displayed is covered with a conductive material, in order to properly ground the EMI layer.

An external light source is generally located over the head of a viewer regardless of an indoor or outdoor environment. An external light shielding sheet 1330 is attached thereto so that external light is effectively shielded and thus black images of the PDP can be rendered even blacker by the PDP.

An adhesive layer 1340 is interposed between the AR/NIR sheet 1310, the EMI sheet 1320 and the external light shielding sheet 1330, so that the sheets 1310, 1320, and 1330 and the filter 1300 can be firmly attached onto the front surface of the PDP. The base sheets interposed between the sheets 1310, 1320, 1330 can be made of the same material in order to facilitate the manufacture of the filter 1300.

According to FIG. 21, the AR/NIR sheet 1310, the EMI sheet 1320, and the external light shielding sheet 1330 are sequentially deposited or stacked. Alternatively, the AR/NIR sheet 1310, the external light shielding sheet 1330 and the EMI sheet 1320 may be sequentially stacked, as illustrated in FIG. 22. The order in which the AR/NIR sheet 1310, the EMI sheet 1320 and the external light shielding sheet 1330 are stacked is not restricted to those set forth herein and illustrated in the figures. At least one of the illustrated sheets 1310, 1320, and 1330 may be omitted or optional, in some implementations.

Figure 23:
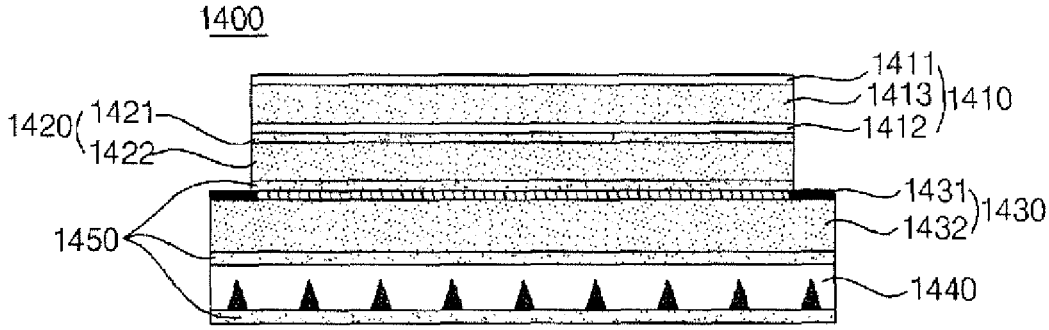
Figure 24:
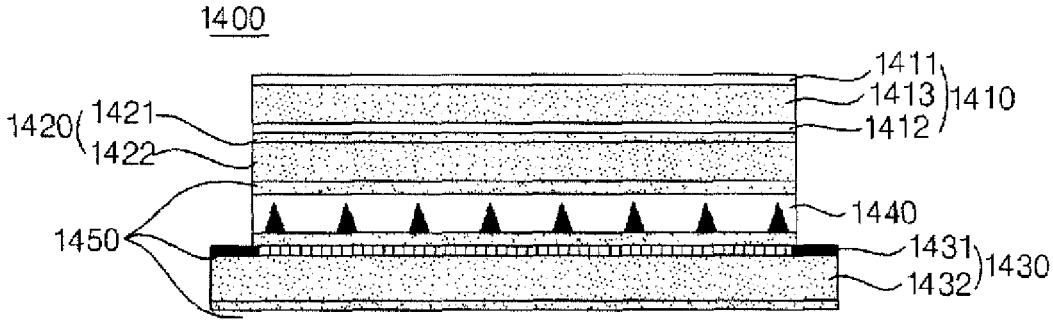

Referring to FIGS. 23 and 24, a filter 1400 disposed at the front surface of the PDP may include an optical sheet 1420, as well as an AR/NIR sheet 1410, an EMI sheet 1430, and an external light shielding sheet 1440. The optical sheet 1420 enhances the color temperature and luminance properties of light from the PDP. The optical sheet 1420 includes a base sheet 1422 formed of a transparent plastic material, and an optical sheet layer 1421 which is formed of a dye and an adhesive on a front or rear surface of the base sheet 1422.

At least one of the base sheets illustrated in FIGS. 21 to 24 may be optional. At least one of the base sheets may be formed of a rigid material (such as hard glass) instead of being formed of a plastic material, so that the protection of the PDP can be enhanced. The glass can be formed at a predetermined spacing apart from the PDP.

In addition, the filter may further include a diffusion sheet. The diffusion sheet serves to diffuse light incident upon the PDP to maintain uniform brightness of the PDP. The diffusion sheet may widen the vertical and horizontal viewing angles and conceal the patterns formed on the external light shielding sheet by uniformly diffusing light emitted from the PDP. Also, the diffusion sheet may enhance the front luminance of a PDP by concentrating light in the direction corresponding to the vertical viewing angle, and can enhance an antistatic property of a PDP.

A transmissive diffusion film or a reflective diffusion film can be used as a diffusion sheet. In general, the diffusion sheet may be comprised of a polymer base sheet containing small glass particles. In some examples, the diffusion sheet may be comprised of a polymethyl-methacrylate (PMMA) base sheet. In this case, the diffusion sheet can be thick and highly heat-resistant and can thus be applied to large-scale display devices, which can generate a considerable amount of heat.

As explained above, a PDP can shield external light incident upon the PDP and prevent light from being reflected so that the bright room contrast of the panel is enhanced while maintaining the luminance of the PDP.

It is possible to effectively realize black images and enhance bright room contrast by arranging the external light shielding sheet, which absorbs and shields external light from the outside, at the front of the display panel. Also, it is possible to obtain an appropriate opening ratio while improving optimum luminance of display images by making the distance between tops to the distance of bottoms of the adjacent pattern units of the external light shielding sheet to be within a predetermined percentage.

Various changes in form and details may be made in the example implementations described and shown, and other implementations are within the scope of the following claims.

What is claimed is:

1. A plasma display device comprising:

a plasma display panel including a first substrate, a second substrate, scan electrodes and sustain electrodes on the first substrate, address electrodes on the second substrate, and barrier ribs on the second substrate on which the address electrodes are located; and a filter disposed at a front surface of the plasma display panel, wherein the filter comprises:

an external light shield sheet including a base unit and a plurality of pattern units formed on the base unit and that have a refractive index higher than that of the base unit, wherein each of the scan electrodes and sustain electrodes includes transparent electrodes and bus electrodes, wherein the barrier ribs include a plurality of vertical barrier ribs and a plurality of horizontal barrier ribs, wherein a ratio of a distance between tops of two adjacent pattern units of the plurality of pattern units to a distance between bottoms of the two adjacent pattern units is 1 to 3.25, and wherein a ratio of a bottom width of each of the pattern units to a width of each of the bus electrodes is 0.25 to 0.4, and a ratio of the bottom width of each of the pattern units to a width of each of the vertical barrier ribs is 0.4 to 0.65.

2. The plasma display device of claim 1, wherein a ratio of the distance between tops of two adjacent pattern units to the distance between bottoms of the two adjacent pattern units is 1.1 to 1.45.

3. The plasma display device of claim 1, wherein the refractive index of the pattern units are 0.05-0.3 higher than the refractive index of the base unit.

4. The plasma display device of claim 1, wherein the distance between tops of two adjacent pattern units of the plurality of pattern units is 90 μm to 130 μm.

5. The plasma display device of claim 1, wherein the distance between bottoms of two adjacent pattern units of the plurality of pattern units is 40 μm to 90 μm.

6. The plasma display device of claim 1, wherein a ratio of a thickness of the external light shield sheet to a height of each of the pattern units is 1.01 to 1.5.

7. The plasma display device of claim 1, wherein a ratio of the distance between bottoms of two adjacent pattern units of the plurality of pattern units to the bottom width of each of the pattern units is 1.15 to 5.

8. The plasma display device of claim 1, wherein the filter comprises at least one of:

an AR layer for preventing reflection of external light;

an NIR shield layer for shielding near-infrared rays emitted from the panel; and an EMI shield layer for shielding electromagnetic waves.

9. A plasma display device comprising:

a plasma display panel including a first substrate, a second substrate, scan electrodes and sustain electrodes on the first substrate, address electrodes on the second substrate, and barrier ribs on the second substrate on which the address electrodes are located; and a filter disposed at a front surface of the plasma display panel, wherein the filter comprises an external light shield sheet including a base unit and a plurality of pattern units formed on the base unit and that have a refractive index higher than that of the base unit, wherein each of the scan electrodes and sustain electrodes includes transparent electrodes and bus electrodes, wherein the barrier ribs include a plurality of vertical barrier ribs and a plurality of horizontal barrier ribs, wherein a ratio of a height of each of the pattern units to a distance between bottoms of two adjacent pattern units of the plurality of pattern units is 0.89 to 4.25, and wherein a ratio of a bottom width of each of the pattern units to a width of each of the bus electrodes is 0.25 to 0.4, and a ratio of the bottom width of each of the pattern units to a width of each of the vertical barrier ribs is 0.4 to 0.65.

10. The plasma display device of claim 9, wherein the refractive index of the pattern units are 0.05-0.3 higher than the refractive index of the base unit.

11. The plasma display device of claim 9, wherein the distance between bottoms of two adjacent pattern units of the plurality of pattern units is 40 μm to 90 μm.

12. The plasma display device of claim 9, wherein a ratio of a thickness of the external light shield sheet to a height of each of the pattern units is 1.01 to 1.5.

13. The plasma display device of claim 9, wherein a ratio of the distance between bottoms of two adjacent pattern units of the plurality of pattern units to the bottom width of each of the pattern units is 1.15 to 5.

* * * * *